US006305469B1

(12) United States Patent
Coenen et al.

(10) Patent No.: US 6,305,469 B1
(45) Date of Patent: Oct. 23, 2001

(54) METHOD OF CREATING A WELLBORE

(75) Inventors: Josef Guillaume Christoffel Coenen; Leo Bernhard Maekiaho, both of Rijswijk (NL)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 09/580,966

(22) Filed: May 30, 2000

(30) Foreign Application Priority Data

Jun. 3, 1999 (EP) ..... 99304350

(51) Int. Cl.[7] ..... E21B 7/00
(52) U.S. Cl. ..... 166/250.01; 175/92
(58) Field of Search ..... 166/250.01, 250.15, 166/250.17, 311, 369, 382, 77.1; 175/19, 20, 46, 92, 97

(56) References Cited

U.S. PATENT DOCUMENTS 4,051,908 * 10/1977 Driver ..... 175/78
5,868,210 * 2/1999 Johnson et al. ..... 175/40
5,944,009 * 8/1999 Longbottom ..... 166/313
6,237,638 * 5/2001 Pringle et al. ..... 166/66

* cited by examiner

*Primary Examiner*—Frank Tsay

(57) ABSTRACT

A method of creating a wellbore in an earth formation, the wellbore including a first wellbore section and a second wellbore section penetrating a hydrocarbon fluid bearing zone of the earth formation, is provided. The method comprises drilling the first wellbore section, arranging a remotely controlled drilling device at a selected location in the first wellbore section, from which selected location the second wellbore section is to be drilled, and arranging a hydrocarbon fluid production conduit in the first wellbore section in sealing relationship with the wellbore wall, the conduit being provided with fluid flow control means and a fluid inlet in fluid communication with said selected location. The drilling device is operated to drill the second wellbore section whereby during drilling of the drilling device through the hydrocarbon fluid bearing zone, flow of hydrocarbon fluid from the second wellbore section into the production conduit is controlled by the fluid flow control means.

17 Claims, 3 Drawing Sheets

METHOD OF CREATING A WELLBORE

BACKGROUND OF THE INVENTION

The present invention relates to a method of creating a wellbore in an earth formation, the wellbore including a first wellbore section and a second wellbore section penetrating a hydrocarbon fluid bearing zone of the earth formation.

In conventional methods of wellbore drilling a drill string including a drill bit at its lower end is rotated in the wellbore while drilling fluid is pumped through a longitudinal passage in the drill string, which drilling fluid returns to surface via the annular space between the drill string and the wellbore wall. When drilling through an earth layer not containing a fluid, the weight and the pumping rate of the drilling fluid are selected so that the pressure at the wellbore wall is kept between a lower level at which the wellbore becomes unstable and an upper level at which the wellbore wall is fractured. When the wellbore is drilled through a hydrocarbon fluid containing zone the drilling fluid pressure should moreover be above the pressure at which hydrocarbon fluid starts flowing into the wellbore, and below the pressure at which undesired invasion of drilling fluid into the formation occurs. These requirements impose certain restrictions to the drilling process, and particularly to the length of the wellbore intervals at which casing is to be installed in the wellbore. For example, if the drilling fluid pressure at the wellbore bottom is just below the upper limit at which undesired drilling fluid invasion into the formation occurs, the drilling fluid pressure at the top of the open-hole wellbore interval can be close to the lower limit at which undesired hydrocarbon fluid influx occurs. The maximum allowable length of the open-hole interval depends on the specific weight of the drilling fluid, the hydrocarbon fluid pressure in the formation, and the height of the drilling fluid column.

Furthermore, it has been practised to drill through a hydrocarbon fluid bearing zone at wellbore pressures below the formation fluid pressure, a methodology commonly referred to as under-balanced drilling. During under-balanced drilling hydrocarbon fluid flows into the wellbore, and consequently the drilling equipment at surface has to be designed to handle such inflow. Moreover, special measures must be taken to control the fluid pressure in the wellbore during the drilling process.

An advantage of the invention is to provide a method of drilling a wellbore through a hydrocarbon fluid bearing zone of the earth formation, which method alleviates the restrictions imposed to the drilling process in conventional wellbore drilling and which allows the wellbore pressure to be below the formation fluid pressure while any hydrocarbon fluid inflow into the wellbore can be adequately handled.

SUMMARY OF THE INVENTION

In accordance with the invention there is provided a method of creating a wellbore in an earth formation, the wellbore including a first wellbore section and a second wellbore section penetrating a hydrocarbon fluid bearing zone of the earth formation, the method comprising drilling the first wellbore section;

arranging a remotely controlled drilling device at a selected location in the first wellbore section, from which selected location the second wellbore section is to be drilled;

arranging a hydrocarbon fluid production conduit in the first wellbore section in sealing relationship with the wellbore wall, the conduit being provided with fluid flow control means and a fluid inlet in fluid communication with said selected location;

operating the drilling device to drill the second wellbore section whereby during drilling of the drilling device through the hydrocarbon fluid bearing zone, flow of hydrocarbon fluid from the second wellbore section into the production conduit is controlled by the fluid flow control means.

By drilling through the hydrocarbon fluid bearing zone using the remotely controlled drilling device, and discharging any hydrocarbon fluid flowing into the wellbore through the production conduit, it is achieved that the wellbore pressure no longer needs to be above the formation fluid pressure. The wellbore pressure is controlled by controlling the fluid flow control means. Furthermore, no special measures are necessary for the drilling equipment to handle hydrocarbon fluid production during drilling.

In case the second wellbore is to be drilled through one or more layers from which no hydrocarbon fluid flows into the wellbore, it is preferred that the drilling device comprises a pump system having an inlet arranged to allow drill cuttings resulting from the drilling action of the drilling device to flow into the inlet, and an outlet arranged to discharge said drill cuttings into the wellbore behind the drilling device.

Suitably said outlet is arranged a selected distance behind the drilling device and at a location in the wellbore section where a fluid is circulated through the wellbore, which fluid entrains the drill cuttings and transports the drill cuttings to surface.

The second wellbore section can be a continuation of the first wellbore section, or can be a side-track (i.e. a branch) of the first wellbore section.

BRIEF DESCRIPTION OF THE DRAWINGS

The invention will be explained hereinafter in more detail and by way of example with reference to the accompanying drawings in which FIG. 1A schematically shows a lower part of an embodiment of a drilling device used in the method of the invention.

DETAILED DESCRIPTION OF THE ILLUSTRATIVE EMBODIMENTS

Figure 1B:
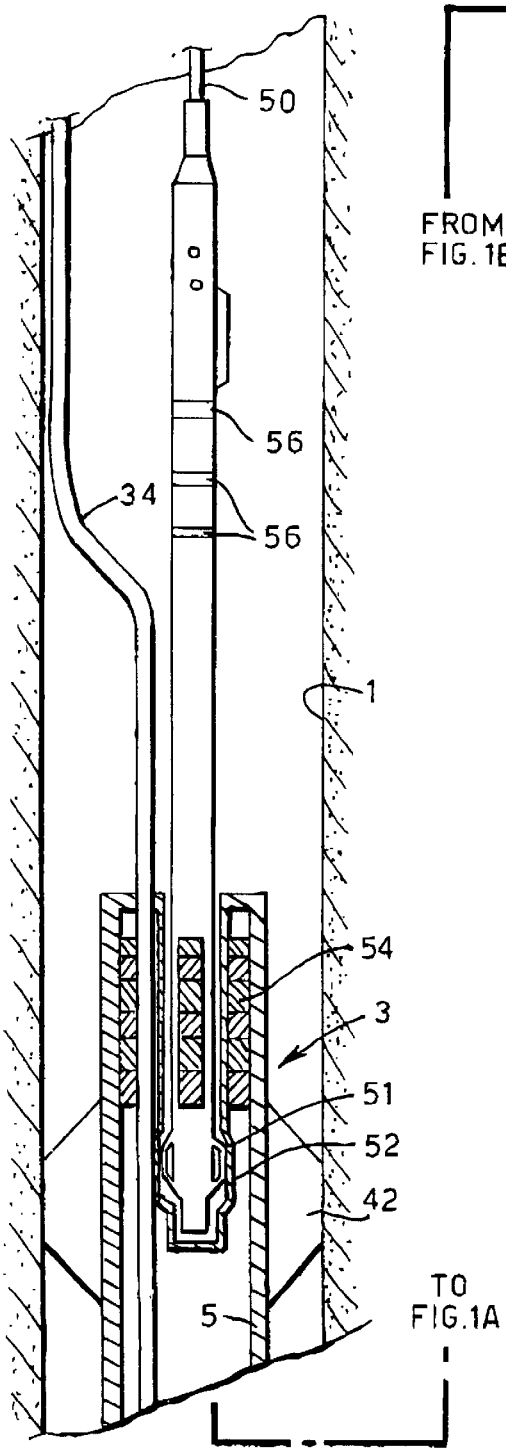
FIG. 1B schematically shows a continuation in upward direction of the embodiment of FIG. 1.
Figure 1A:
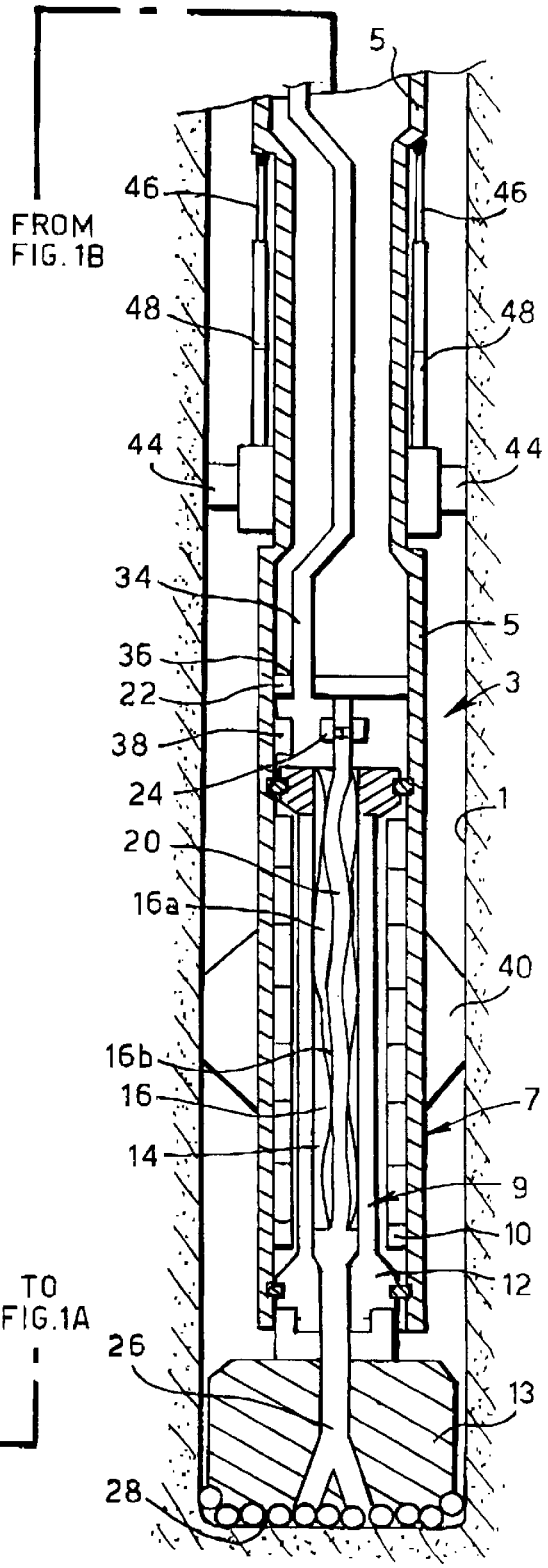

Referring to FIGS. 1A and 1B there is shown a wellbore 1 in which a remotely controlled drilling device 3 is arranged. The drilling device 3 has a cylindrical housing 5 provided with an motor/pump assembly 7 including an electric motor 9 having a cylindrical stator 10 and a hollow rotor 12 coaxially arranged within the stator. The rotor 12 is arranged to drive a drill bit 13 located at the lower end of the drilling device 3. A pump 14 of the assembly 7 is similar in construction to a wellknown Moineau type motor and consists of a rotor 16 formed by a cylindrical body of elastomeric material 16*a* having a longitudinal, lobed passage 16*b*, and a stator 20 formed by a helical member extending through the passage 16*b*. The body of elastomeric material 16*a* and the helical member 20 are dimensioned such that fluid is pumped through the passage 16*b* upon rotation of the body of elastomeric material 16*a* relative to the helical member 20, whereby the pumping direction depends on the direction of relative rotation. The body of elastomeric material 16*a* is fixedly connected to the inner surface of the rotor 12 of the electric motor so that during normal operation the body of elastomeric material 16*a* is rotated by the rotor 12. The direction of rotation of the electric motor 9 is such that during operation of the motor fluid is pumped through the passage 16*b* in the direction away from the drill bit 13. The helical member 20 is at the end thereof opposite the drill bit 13 connected to a bulkhead 22 via an electrically operated clutch 24, the bulkhead 22 being fixedly arranged within the housing 5. When in engaged mode, the clutch 24 prevents rotation of the helical member 20 relative to the bulkhead 22, and, when in disengaged mode allows rotation of the helical member 20 relative to the bulkhead 22.

The drill bit 13 is provided with a passage 26 providing fluid communication between the bottom 28 of the drill bit 13 and the passage 16*b*. The passage 16*b* is at the side remote from the drill bit 13 in fluid communication with an outlet conduit 34 passing through an opening 36 provided in the bulkhead 22 and extending a selected distance into the wellbore 1 away from the drill bit 13. A device 38 for breaking drill cuttings by mechanical or electromagnetic means into small particles is arranged in the housing 5 between the pump 14 and the opening 36 provided in the bulkhead 22.

The housing 5 is provided with a front stabiliser 40 arranged near the drill bit 13 and a rear stabiliser 42 arranged near the end of the housing 5 opposite the drill bit 13. Both stabilisers 40, 42 are operable so as to be concentrically or eccentrically positioned relative to the housing 5 by electronic control means (not shown). A set of four hydraulically operated, radially extendible grippers 44 (only two of which are shown) is arranged at a selected location between the stabilisers 40, 42. Each gripper 44 is slideable a selected stroke in longitudinal direction of the housing 5 along a guide bar 46 provided at the housing 5. The housing is provided with a hydraulically operated thruster assembly 48 for thrusting each gripper 44 along its respective guide bar 46. The grippers 44 and the thruster assembly 48 are operated by hydraulic power and controlled by an electronic control system (not shown). The hydraulic power is supplied by a pump unit (not shown) driven by a secondary electric motor (not shown).

An electric conductor wire in the form of cable 50 is connected to the end of the housing 5 opposite the drill bit 13, by means of a releasable connector 51 which includes a latching mechanism (not shown) for latching the cable 50 into a recess 52 provided at the rear end of the housing 5. An inductive coupler 54 connects the cable 50 to the electric motor 9, the device 38, the control means for the stabilisers 40, 42, the secondary electric motor for driving the fluid pump, the electronic control system for the grippers and the thruster assembly, and the electrically operated clutch 24 and mechanical coupling 58. The end of the cable near the mechanical connector 51 is provided with a plurality of formation evaluation sensors 56 electrically connected to recording equipment (not shown) at surface via the cable 50.

To retrieve the cable 50 from the drilling device 3 in case of a power failure via the cable 50, the drilling device 3 is provided with an independent electric power source (not shown) which radially retracts the grippers 44 and releases the connector 51 in case of such power failure.

An inertial navigation system (INS, not shown) is included in the drilling device 3 for sampling data to assist navigation of the drilling device 3 through the wellbore 1.

Normal operation of the drilling device 3 is described hereinafter with further reference to FIGS. 2 and 3.

Figure 2:
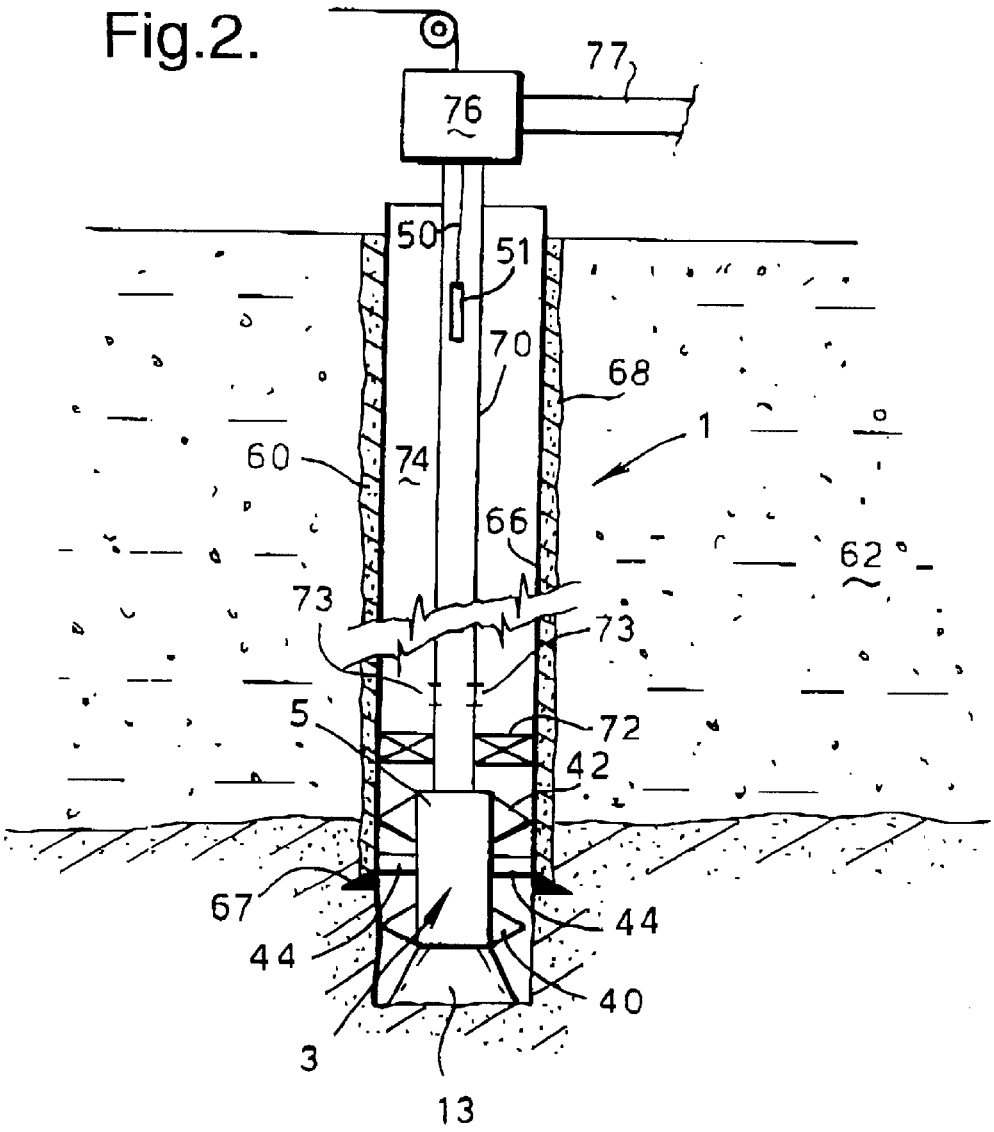
FIG. 2 schematically shows the drilling device of FIGS. 1A and 1B before drilling of the second wellbore section.

Referring to FIG. 2, a first section 60 of the wellbore 1 is drilled through an upper earth formation layer 62 until the wellbore 1 reaches a hydrocarbon fluid reservoir layer 64 of the earth formation located below the upper layer 62. A conventional drilling assembly is used for this purpose, and the wellbore 1 is filled with a suitable drilling fluid. A metal casing 66 with a casing shoe 67 at its lower end is arranged in the first wellbore section 60 and fixed to the wellbore wall by a layer of cement 68. The drilling device 3 is releasably connected to the lower end of a hydrocarbon production tubing 70 by a suitable connecting device (not shown), which tubing 70 is at its lower end part provided with an inflatable packer 72 and with two circulation ports 73 located just above the packer 72, the circulation ports 73 being operable between an open position and a closed position by fluid pressure pulses external the tubing 70. The tubing 70 is then lowered into the casing 66 until the drilling device 3 is near the bottom of the first wellbore section 60, whereafter the tubing is fixed to the casing by inflating the packer 72 which seals the annular space 74 formed between the tubing 70 and the casing 66. A wellhead 76 at surface provides fluid communication between the tubing 70 and a hydrocarbon fluid processing facility (not shown) via a pipe 77. The wellhead 76 is provided with a valve (not shown) for controlling flow of fluid from the tubing 70 to the processing facility. The annular space 74 above the packer 72 is filled with brine.

The cable 50 is lowered through an opening (not shown) in the wellhead 76 and through the tubing 70 until the latching mechanism of the cable 50 latches into the recess 52 of the drilling device 3. If necessary the cable 50 is pumped through the tubing 70 until the latching mechanism latches into the recess 52, in which case the circulation ports 73 are first opened by a fluid pressure pulse from the brine in the annular space.

Figure 3:
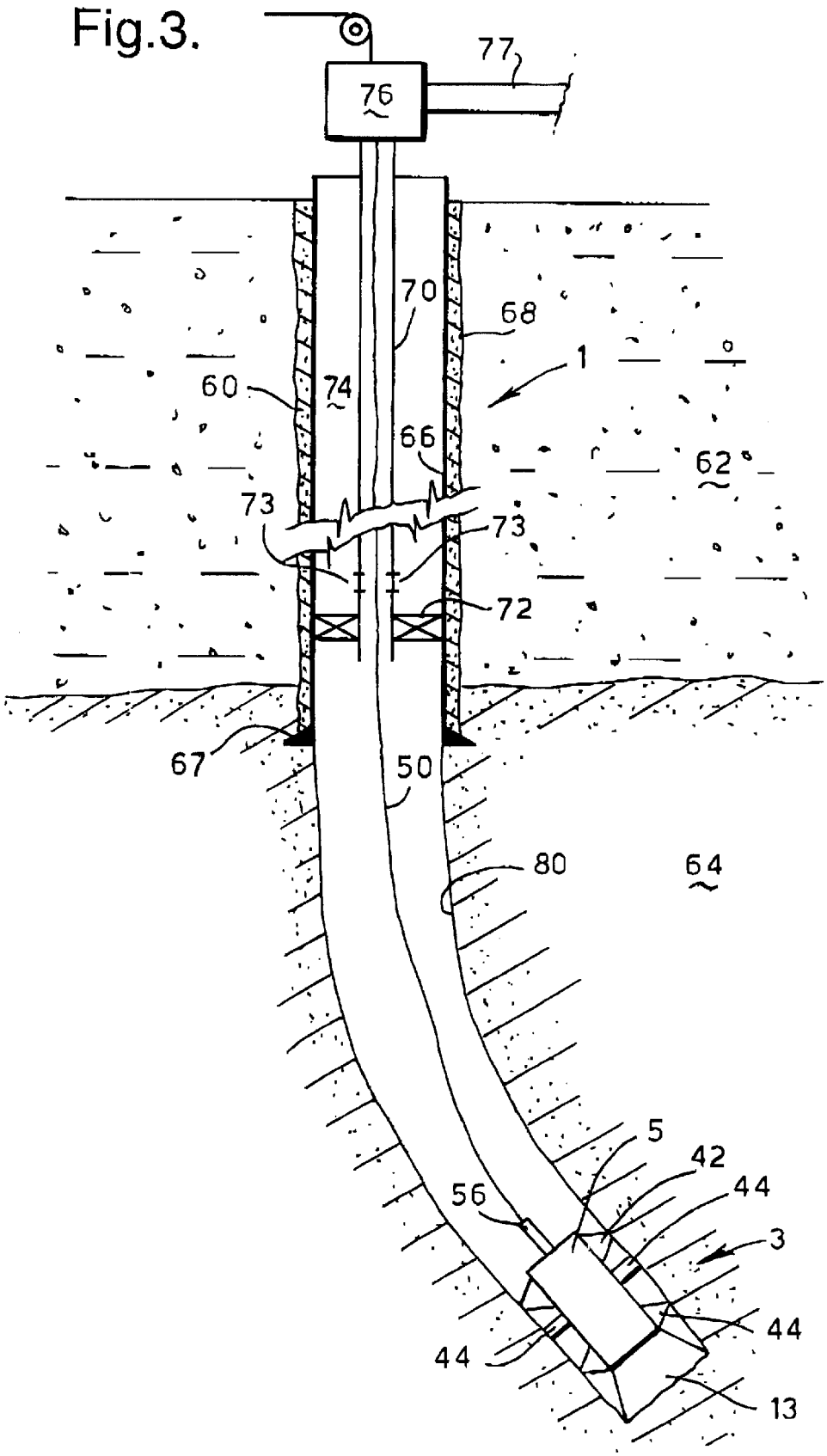
FIG. 3 schematically shows the drilling device of FIGS. 1A and 1B during drilling the second wellbore section.

Referring further to FIG. 3, a second wellbore section 80 is drilled using the drilling device 3 in the manner described hereinafter, the second wellbore section being a continuation of the first wellbore section 60 and extending into the reservoir layer 64. To start drilling of the second wellbore section 80, electric power is supplied via cable 50 to the secondary electric motor thereby driving the pump unit which supplies hydraulic power to the grippers 44 and the thruster assembly 48. Control signals are supplied via the cable 50 to the clutch 24 so as to disengage the clutch and to the electronic control system so as to induce the grippers 44 to radially extend until the grippers 44 are firmly pressed against the casing 66, and thereafter to induce the thruster assembly 48 to thrust the grippers 44 along their respective guide bars in rearward direction thereby thrusting the drill bit 13 against the wellbore bottom. Simultaneously electric power is supplied via the cable 50 to the electric motor 9 thereby rotating the drill bit 13. The helical member 20 rotates together with the rotor 12 and with the body of elastomeric material 16*a* by virtue of the clutch 24 being disengaged, so that the pump 14 is not operating.

As a result of the rotation of the drill bit 13 against the wellbore bottom the wellbore is deepened until the grippers 44 reach the end of their stroke in rearward direction. The electronic control system is then operated to induce the grippers to radially retract, to move the grippers 44 to the end of their stroke in forward direction, and to induce the grippers 44 to radially extend until becoming firmly pressed against the wellbore wall. The thruster assembly 48 is then induced to thrust the grippers 44 again in rearward direction thereby deepening the wellbore 1 a further incremental depth. This procedure is repeated as many times as necessary to reach the desired depth of the wellbore 1. If the wellbore trajectory needs to be changed the electronic control means for controlling the stabilisers 40, 42 is operated to induce the stabilisers to assume a selected eccentric position relative to the housing 5 so that the drill bit 13 becomes tilted in the wellbore 1 and thereby starts drilling a curved wellbore section. Once the desired orientation of the wellbore 1 is reached, the stabilisers are induced to assume a concentric position relative to the housing 5 resulting in further drilling of a straight section.

As drilling with the drilling device 3 proceeds, the formation evaluation sensors 56 are operated to measure selected earth formation characteristics and to transmit signals representing the characteristics via the cable 50 to the recording equipment at surface.

During drilling of the second wellbore section 80 hydrocarbon fluid flows from the reservoir layer 64 into the second wellbore section 80, and from there via the tubing 70, the wellhead 76, and the pipe 77 to the processing equipment. The drilling fluid initially present in the wellbore 1 is thereby gradually replaced by hydrocarbon fluid. The rate of flow is dependent on a pressure difference between the reservoir layer 64 and the interior of the second wellbore section 80, and is controlled by controlling the valve at the wellhead 76. As the hydrocarbon fluid flows through the second wellbore section 80, the drill cuttings resulting from the drilling process are entrained into the stream of hydrocarbon fluid and transported to the processing facility.

In case the earth formation includes a plurality of reservoir layers separated by rock layers (containing no fluid), the drill cuttings are removed from the wellbore during drilling of the drilling device through a rock layer in the following manner. Suitable control signals are transmitted via the cable 50 to the clutch 24 so as to engage the clutch 24 and to operate the device 38. As a result of the clutch becoming engaged the helical member 20 of the pump 14 becomes stationary while the body of elastomeric material 16*a* rotates, so that the pump 14 pumps fluid present in the wellbore (hydrocarbon fluid, drilling fluid or a mixture thereof) from the wellbore bottom through the passages 26, 16*b* and the outlet conduit 34 into the wellbore 1 at the rear end of the conduit 34. Drill cuttings present at or near the wellbore bottom are entrained by the fluid being pumped and are therefore also discharged into the wellbore 1 at the rear end of the outlet conduit 34. As the drill cuttings pass along the device 38, the drill cuttings are broken into smaller particles by device 38. The length of the conduit 34 is such that the rear end thereof extends into a part of the wellbore where hydrocarbon fluid flows into the wellbore 1, i.e. where the wellbore crosses a reservoir layer. The drill cuttings which are discharged at the rear end of the outlet conduit 34 are entrained by the hydrocarbon fluid flowing into the wellbore 1 and are transported by the hydrocarbon fluid to surface.

Instead of the drill cuttings being discharged in a part of the wellbore where hydrocarbon fluid flows from the formation into the wellbore, the cuttings can be discharged in a part of the wellbore where drilling fluid (or any other suitable fluid) is circulated through the wellbore so that the cuttings are entrained by the circulating drilling fluid (or other suitable fluid).

After the wellbore is drilled to the desired depth the drilling device 3 can be left in the wellbore, in which case the cable 50 is released from the drilling device 3 and retrieved to surface.

Alternatively, only a first part of the drilling device can be left in the wellbore while a second part of the drilling device is retrieved. In such case the two parts are connected to each other by suitable connecting means being releasable by remote control, for example by an electric signal supplied to the drilling device via the cable. The second part is retrieved by simultaneously retrieving the cable and the second part through the tubing.

Other modifications, changes and substitutions are also intended in the foregoing disclosure. Further, in some instances, some features of the present invention will be employed without a corresponding use of other features described in these illustrative embodiments. Accordingly, it is appropriate that the appended claims be construed broadly and in a manner consistent with the spirit and scope of the invention herein.

What is claimed is:

1. A method of creating a wellbore in an earth formation, the wellbore including a first wellbore section and a second wellbore section penetrating a hydrocarbon fluid bearing zone of the earth formation, the method comprising:

drilling the first wellbore section;

arranging a remotely controlled drilling device at a selected location in the first wellbore section, from which selected location the second wellbore section is to be drilled;

arranging a hydrocarbon fluid production conduit in the first wellbore section in sealing relationship with the wellbore wall, the conduit being provided with fluid flow control means and a fluid inlet in fluid communication with said selected location;

operating the drilling device to drill the second wellbore section whereby during drilling of the drilling device through the hydrocarbon fluid bearing zone, flow of hydrocarbon fluid from the second wellbore section into the production conduit is controlled by the fluid flow control means.

2. The method of claim 1, wherein arranging the drilling device in the first wellbore section comprises suspending the drilling device from the production conduit, and simultaneously lowering the production conduit and the drilling device into the first wellbore section.

3. The method of claim 2, wherein the first wellbore section is provided with a casing and the production conduit is at the lower end part thereof provided with an inflatable packer for sealing the conduit relative to the casing, and wherein the drilling device is releasably connected to said packer during simultaneous lowering of the production conduit and the drilling device into the first wellbore section.

4. The method of claim 1, wherein the drilling device is operated by electric power, and the method further comprises lowering an electric conductor wire through the production conduit and connecting the conductor wire to the drilling device.

5. The method of claim 4, wherein the conductor wire is lowered through the production conduit by connecting a pump-down element to the wire and pumping the pump-down element through the production conduit.

6. The method of claim 4, wherein the drilling device is provided with means for measuring data on at least one of a formation characteristic, a wellbore characteristic, and a drilling characteristic, and wherein the method further comprises transmitting said data through the conductor wire to surface.

7. The method of claim 1, wherein the drilling device comprises a front member including a drill bit, a rear member provided with retractable anchoring means for anchoring the rear member to the borehole wall, the front member and rear member being arranged in a telescoping relationship, and thrust means for thrusting the front member in telescoping outward direction relative to the rear member, and wherein the step of operating the drilling device includes anchoring the rear member to the borehole wall and inducing the thrust means to thrust the front member in telescoping outward direction relative to the rear member and against the borehole bottom.

8. The method of claim 1, wherein the drilling device comprises a pump system having an inlet arranged to allow drill cuttings resulting from the drilling action of the drilling device to flow into the inlet, and an outlet arranged to discharge said drill cuttings into the wellbore behind the drilling device.

9. The method of claim 8, wherein said outlet is arranged a selected distance behind the drilling device and at a location in the wellbore section where a fluid is circulated through the wellbore, which fluid entrains the drill cuttings and transports the drill cuttings to surface.

10. A method of creating a wellbore in an earth formation, the wellbore including a first wellbore section and a second wellbore section penetrating a hydrocarbon fluid bearing zone of the earth formation, the method comprising:

drilling the first wellbore section;

arranging a remotely controlled drilling device at a selected location in the first wellbore section, from which selected location the second wellbore section is to be drilled; wherein arranging the drilling device comprising suspending the drilling device from a production conduit, and simultaneously lowering the production conduit and the drilling device into the first wellbore section;

arranging a hydrocarbon fluid production conduit in the first wellbore section in sealing relationship with the wellbore wall, the conduit being provided with fluid flow control means and a fluid inlet in fluid communication with said selected location;

operating the drilling device to drill the second wellbore section whereby during drilling of the drilling device through the hydrocarbon fluid bearing zone, flow of hydrocarbon fluid from the second wellbore section into the production conduit is controlled by the fluid flow control means.

11. The method of claim 10, wherein the first wellbore section is provided with a casing and the production conduit is at the lower end part thereof provided with an inflatable packer for sealing the conduit relative to the casing, and wherein the drilling device is releasably connected to said packer during simultaneous lowering of the production conduit and the drilling device into the first wellbore section.

12. The method of claim 11, wherein the drilling device is operated by electric power, and the method further comprises lowering an electric conductor wire through the production conduit and connecting the conductor wire to the drilling device.

13. The method of claim 12, wherein the conductor wire is lowered through the production conduit by connecting a pump-down element to the wire and pumping the pump-down element through the production conduit.

14. The method of claim 13, wherein the drilling device is provided with means for measuring data on at least one of a formation characteristic, a wellbore characteristic, and a drilling characteristic, and wherein the method further comprises transmitting said data through the conductor wire to surface.

15. The method of claim 14, wherein the drilling device comprises a front member including a drill bit, a rear member provided with retractable anchoring means for anchoring the rear member to the borehole wall, the front member and rear member being arranged in a telescoping relationship, and thrust means for thrusting the front member in telescoping outward direction relative to the rear member, and wherein the step of operating the drilling device includes anchoring the rear member to the borehole wall and inducing the thrust means to thrust the front member in telescoping outward direction relative to the rear member and against the borehole bottom.

16. The method of claim 15, wherein the drilling device comprises a pump system having an inlet arranged to allow drill cuttings resulting from the drilling action of the drilling device to flow into the inlet, and an outlet arranged to discharge said drill cuttings into the wellbore behind the drilling device.

17. The method of claim 16, wherein said outlet is arranged a selected distance behind the drilling device and at a location in the wellbore section where a fluid is circulated through the wellbore, which fluid entrains the drill cuttings and transports the drill cuttings to surface.

* * * * *